US006739232B2

(12) United States Patent
Porter et al.

(10) Patent No.: US 6,739,232 B2
(45) Date of Patent: May 25, 2004

(54) TOWED AIRBORNE VEHICLE CONTROL AND EXPLOSION DAMAGE ASSESSMENT

(75) Inventors: David R. Porter, Huntsville, AL (US); James J. Galipeau, Union Grove, AL (US); George C. Chandler, Grant, AL (US)

(73) Assignee: Sanmina-SCI Corporation, San Jose, CA (US)

( * ) Notice: Subject to any disclaimer, the term of this patent is extended or adjusted under 35 U.S.C. 154(b) by 4 days.

(21) Appl. No.: 10/062,093

(22) Filed: Jan. 31, 2002

(65) Prior Publication Data

US 2003/0140773 A1 Jul. 31, 2003

(51) Int. Cl.[7] ..... B64D 1/04
(52) U.S. Cl. ..... 89/1.11; 244/1 TD
(58) Field of Search ..... 244/1 TD; 89/1.11; 348/144

(56) References Cited

U.S. PATENT DOCUMENTS

| | | | | |
|---|---|---|---|---|
| 2,876,963 A | * | 3/1959 | Se Legue et al. | 244/3 |
| 3,143,346 A | | 8/1964 | Bulow | |
| 3,623,726 A | | 11/1971 | Pittinger | |
| 4,356,984 A | | 11/1982 | Worth et al. | |
| 4,412,662 A | * | 11/1983 | Rutecki | 242/125.3 |
| 4,718,320 A | | 1/1988 | Brum | |
| 4,770,368 A | | 9/1988 | Yates et al. | |
| 4,852,455 A | | 8/1989 | Brum | |
| 5,014,997 A | * | 5/1991 | Smith et al. | 273/360 |
| 5,083,723 A | * | 1/1992 | Grieb et al. | 244/1 TD |
| 5,179,612 A | | 1/1993 | Rochester | |
| 5,189,253 A | | 2/1993 | LeCompte | |
| 5,333,814 A | | 8/1994 | Wallis | |
| 5,432,546 A | | 7/1995 | Cargill | |
| 5,497,156 A | | 3/1996 | Bushman | |
| 5,603,470 A | | 2/1997 | Fitzgerald et al. | |
| 5,605,306 A | | 2/1997 | Fitzgerald et al. | |
| 5,678,785 A | | 10/1997 | Porter | |
| 5,836,535 A | | 11/1998 | Brum | |
| 6,345,784 B1 | * | 2/2002 | Shnaps | 244/3.15 |

OTHER PUBLICATIONS

Joseph A. Carroll and Charles M. Alexander—"Tether Deployer and Brake"—NASA Tech Briefs, Nov., 1993 pp. 93–94.

* cited by examiner

*Primary Examiner*—Michael J. Carone
*Assistant Examiner*—M. Thomson

(57) ABSTRACT

Device and method for controlling a towed vehicle such as a bomb damage detector towed on a tether cord behind the bomb. The towed vehicle is ejected from the bomb at a selected release point in its trajectory. A tether cord is wound on a spool and dispensed from the spool longitudinally. The payout of tether cord is braked by a brake using the wrapping of the cord around a curved guide to increase the braking force supplied by an electric brake. The vehicle can be completely released from the cord prior to the bomb explosion to increase the viewing time without increasing the length of the cord. A vehicle towed by an aircraft can be recovered by use of a winch in the aircraft and anchoring the tether at the winch. A portion of the tether cord can be covered with a fire-resistant covering to protect it from the hot exhausts of jet or rocket engines on the aircraft.

13 Claims, 5 Drawing Sheets

TOWED AIRBORNE VEHICLE CONTROL AND EXPLOSION DAMAGE ASSESSMENT

This invention relates to means and methods for controlling towed airborne vehicles and for the use of such vehicles in assessing the damage created by the explosion of a bomb, a missile, or similar traveling explosive device.

Towed airborne vehicles, such as bomb damage assessment devices, are well known. Towed damage assessment vehicles are towed behind a bomb, and use a video camera to view the area of the bomb explosion. The vehicle in which the video camera is located is mounted in or on the bomb, released during flight of the bomb, and is towed by the bomb at a distance behind it so that the camera can take pictures of the explosion site for a period of time after the explosion occurs and before the camera is destroyed.

This enables personnel viewing the video pictures to determine whether the bomb has hit the desired target, and the extent of the damage done.

In prior devices of this type, the tether line for towing the vehicle is wound on a reel mounted in or on the bomb. The vehicle is deployed by use of an explosive device, and the tether unwinds from the reel. The unwinding speed is controlled by a centrifugal brake.

Various problems have been experienced with such prior bomb damage assessment devices. First, the length of the tether is relatively short so that the viewing time after the explosion is limited.

Accordingly, it is an object of the present invention to produce a damage assessment device and method in which the explosion site viewing time is substantially greater than in the past.

Another problem with such prior devices is that shock forces upon release of the towed vehicle and upon stopping the dispensing of the tether line tend to be relatively large. This puts relatively great stress on the tether.

Accordingly, it is another object of the invention to provide a damage assessment device and method in which the shock forces and the tether line diameter are minimized.

Another problem with such prior devices is that the tether dispensing equipment used is relatively large, heavy, and costly.

Accordingly, it is another object of the present invention to provide a damage assessment device and method in which the assessment vehicle is relatively small, lightweight and inexpensive to manufacture.

It is a further object of the invention to provide a damage assessment device and method having the foregoing desirable attributes which does not require excessive electrical power to operate, and which is relatively resistant or impervious to electromagnetic interference signals.

An additional object of the invention is to provide a device of the type described above which can be used with a minimum of modification of the bomb, missile or other "mother craft" in or on which the vehicle is carried.

The problems of controlling a towed airborne vehicle such as a decoy or target towed behind an airplane also are addressed by the present invention. Accordingly, it also is an object of the invention to provide means for improving the deployment and flight of such vehicles.

Special problems are caused by the need to recover towed vehicles, especially when they are expensive to replace. Again, the space available for recovery equipment is limited.

When the mother craft towing the vehicle is a jet or rocket-propelled craft, there is the problem that the tether cord can be burned by the jet or rocket exhaust, if the aircraft turns. This often requires the aircraft to be modified or other expensive measures taken to ensure the freedom to maneuver the aircraft without loss of the towed vehicle.

Accordingly, it is an object of the invention to provide compact means for deploying and recovering towed vehicles, and preventing either the loss of the towed vehicle or the maneuverability of the mother craft due to burning of the tether cord.

In accordance with the present invention, the foregoing objects are satisfied by the provision of a towed vehicle control and damage assessment device and method in which an electrically-operated brake is used to stop the dispensing of tether cord gradually, so as to minimize shock. Also, the dispensing of tether cord can be stopped and started easily so as to allow greater control over the movement of the towed vehicle.

Tether line or cord preferably is wound on an elongated spool and is dispensed longitudinally over one end flange of the spool. The tether line drives a relatively light-weight rotor while the wound pack of cord remains stationary. This reduces the mass of the rotating body and facilitates braking with a small, lower-power brake, and facilitates using a longer tether line without adding excessively to the vehicle size and braking load.

Preferably, the braking force provided by the brake greatly multiplied by use of a curved conduit, preferably a sinuous conduit, as a cord guide, with the tether line bent around the curve(s) of the conduit so as to minimize the electrical power required by the brake to do its work. Also, the curved conduit can be used as a friction brake to slow the dispensing of the tether cord.

The shock force on the tether line created by the initial release of the towed vehicle is reduced by a selected one of or combination of methods, including reducing the explosive charge used to project the vehicle from the "mother craft", that is, the bomb, missile or aircraft, and/or deploying a ribbon streamer or a small parachute or other drag-increasing means from the vehicle to pull it out of the mother craft at a more gradual rate than that provided by explosive propulsion.

In one embodiment of the invention, the size and weight of the towed vehicle can be reduced by embedding electrical power wires in the tether line, either alone or with a fiber-optic cable for supplying communication signals. Provision of the wires eliminates the need for an on-board battery, or reduces the size and weight of the battery needed. The fiber-optic cable allows the transmission of command signals from the computer in the mother craft to the towed vehicle without enemy "jamming" or other interference.

Recovery means are provided for recovering a towed vehicle. A winch is mounted in the mother craft to pull the vehicle into the craft after deployment and use of the towed vehicle. Thus, the dispensing mechanism and brake within the towed vehicle are used for deployment and the winch is used for retrieval. This minimizes the weight of and electrical power needed in the towed vehicle, and makes it unnecessary to cut the vehicle loose and lose it when its task is finished.

Advantageously, because the dispensing is done by a mechanism within the towed vehicle, the anchor point for the tether line can be fixed on the mother craft. Thus, a fire-resistant covering can be used to protect a relatively short portion of the tether line from being burned by the hot engine exhausts(s) of the mother craft's engine(s) when the mother craft turns. The distance to which the towed craft is towed is completely unrestricted by the use of such a covering.

The foregoing and other objects and advantages of the invention will be apparent from or set forth in the following description and drawings.

IN THE DRAWINGS

GENERAL DESCRIPTION

Figure 1:
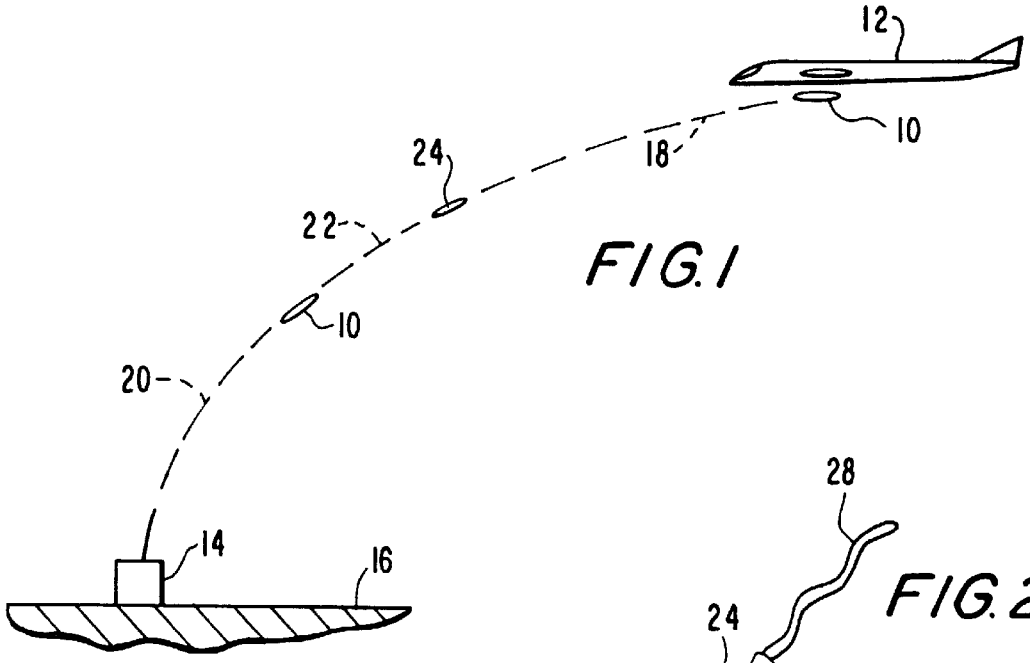
FIG. 1 is a schematic perspective view illustrating one of the typical uses of the device and method of the present invention.

FIG. 1 is a schematic illustration of the use of the invention to assess damage caused by dropping a bomb 10 from an aircraft 12 onto a target. The target 14 is located on the ground 16, but can be floating on a body of water or elsewhere.

The bomb 10 can be a laser-guided or GPS-guided bomb or an unguided ballistic bomb. Alternatively, the bomb 10 can have its own propulsion system and can be, in effect, a guided missile such as a "cruise" missile. Of course, the "mother craft" also can be an airplane instead of a bomb.

The bomb, in the instance illustrated in FIG. 1, does not have its own propulsion system. It falls along a trajectory, the first part of which is shown at 18 and the last part of which is shown at 20.

A towed vehicle 24 is mounted in or onto the bomb 10 and attached by a tether cord or line 22 to the bomb 10. A preprogrammed computer in the bomb or in the vehicle 24 develops a release signal which causes the deployment of the vehicle 24 and the dispensing of the tether cord until the vehicle 24 is a substantial distance behind the bomb.

When the bomb 10 explodes, a camera contained in the towed vehicle 24 will take pictures of the explosion site for an additional length of time after the explosion, until the explosion disables the assessment device.

Figure 2:
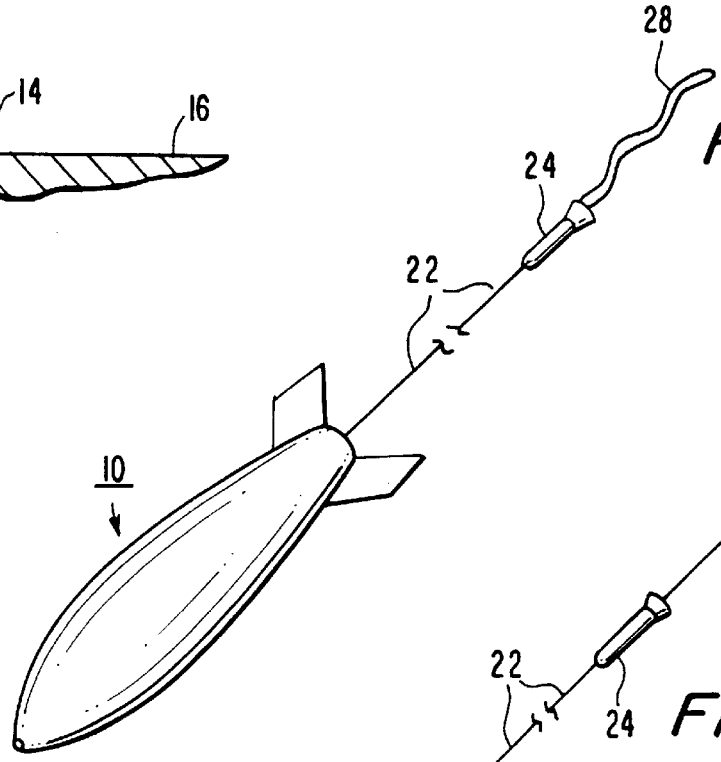
FIG. 2 is a perspective view of a traveling explosive device such as a bomb with a tether constructed in accordance with one embodiment of the present invention.
Figure 2A:
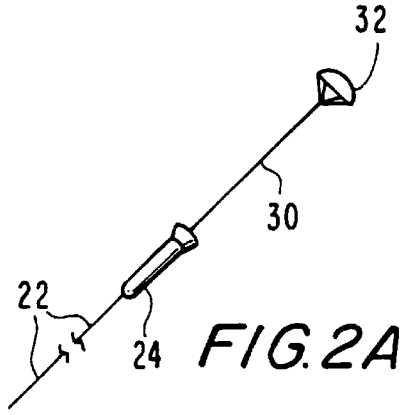
FIG. 2A is a perspective view, like FIG. 2, of another embodiment of the invention.
Figure 2B:
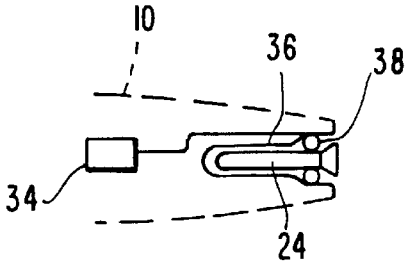
FIG. 2B is a schematic diagram of a further embodiment of the invention.

As illustrated schematically in FIG. 2B, the bomb 10 has an internal computer 34. The vehicle 24 initially is stored in a compartment 36 within the bomb, or is attached to the exterior of the bomb An explosive device indicated schematically at 38 is used to eject the towed vehicle 24 rearwardly from the cavity 36 and pull out tether line from a reel (not shown in FIG. 12B) until around 200 to 250 feet of line has been pulled out. Then, the brake stops the dispensing of line, and the vehicle is towed behind the bomb 10 at a constant distance until the bomb explodes.

The vehicle 24 contains its own power supply and RF transmitter, as well as a video camera. The pictures taken by the video camera are transmitted to a remote receiver, either on the aircraft 12, or elsewhere to provide information regarding damage caused by the explosion.

Towed Vehicle Deployment

FIGS. 2 and 2A show two alternative deployment approaches which can be used in order to reduce the shock on the tether line 22 produced by explosive deployment such as that shown in FIG. 2B.

In the embodiment shown in FIGS. 2 and 2A, deployment is caused by increasing the drag forces on the vehicle 24. This is done, in the FIG. 2 embodiment, by releasing a ribbon or banner 28 from the vehicle 24. This creates a substantial additional drag on the vehicle which pulls it out of the compartment 36 in the bomb 12. After it has been pulled free from the bomb 10 and the low-pressure area in the bomb's wake, the naturally greater slowing effect of drag on the vehicle 24 than on the bomb 10 will pull on the line and unwind it to lengthen the distance between the towed vehicle and the bomb. If needed, the ribbon or tape 28 can be released from the vehicle 24 a short time after its deployment because then its added drag is unnecessary, and may be a hindrance to proper deployment.

FIG. 2A shows another alternative deployment means in which a small parachute 32 attached to a line 30 is ejected from the vehicle 24 to pull it away from the bomb instead of the ribbon 28. Otherwise, this deployment method operates in the same manner as that shown in FIG. 2.

Other drag-increasing means such as flaps can be used instead of ribbons or parachutes, if it is advantageous to do so.

There are a number of devices known capable of deploying the ribbon 28 or the parachute 32. These include small explosive-driven or compressed air-driven pistons, spring-loaded projection devices, etc. Since the tension on the tether line is increased by the drag on the ribbon or parachute and not by the power of an explosion, each of these devices is capable of deploying the vehicle 24 without applying excessive shock forces to the tether cord 22.

As it was mentioned above, the creation of excessive shock loads on the tether cord by use of an explosive as shown in FIG. 2B also can be avoided by reducing the explosive charge to the lowest level capable of ejecting the vehicle.

In each case, the timing of the deployment is stored in or is determined by the bomb computer 34 so that the vehicle 24 is released at the appropriate point in the bomb trajectory.

Deployment Methods

Several methods of deployment are possible when using the invention. First, the vehicle 24 can be deployed at a predetermined point in the bomb trajectory by unwinding of the tether line, stopping when the tether cord or line has been dispensed by the desired amount, and towing the vehicle 24 at a fixed distance behind the bomb until it explodes. This method requires a relatively long tether line in order to obtain maximum viewing time between the explosion and the destruction of the towed vehicle. The present invention facilitates this simple deployment method by providing the longest length of tether line for a given weight and size of the towed vehicle.

Advantageously, the present invention facilitates other unique procedures. In one such procedure, a relatively short length of tether line is used. The vehicle 24 is deployed relatively early in the bomb trajectory, as it often is desired. Later in the trajectory, when the bomb is nearer its target, the towed vehicle is released completely to fly on towards the target on its own. The greater effect of drag on the towed vehicle relative to the bomb quickly causes it to separate further from the bomb, thus greatly lengthening the time for viewing the explosion.

By the use of proper timing, and depending upon the steepness of the trajectory, the vehicle will remain pointed at the target without the tether cord for the remainder of its flight after being released.

If necessary, internal guidance controls can be provided in the vehicle 24 to control fins on the vehicle to maintain the camera in proper alignment with the bomb. For example, an infrared eacon signal or rf data link signals can be transmitted from the bomb and sensed in the released vehicle, if needed to guide the vehicle.

If it is necessary or desired to prevent the vehicle 24 from rolling, a conventional gyroscopic roll stabilization mechanism can be used. The pulling of the tether cord over a sprocket wheel with a one-way clutch driving the gyroscope can be used to provide power for the roll stabilization system.

Electrical Systems

Figure 3:
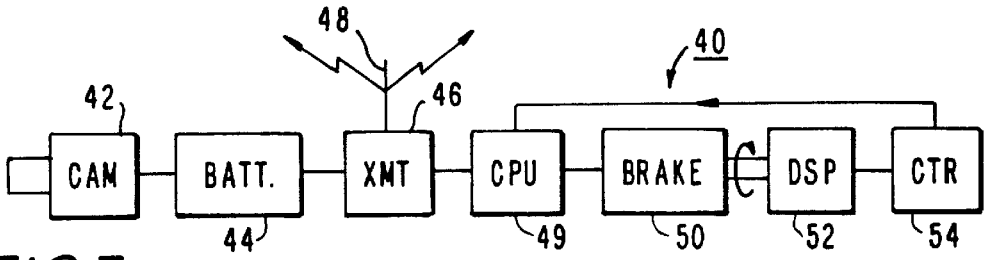
FIG. 3 is a schematic circuit diagram showing one embodiment of the electrical system of the invention.
Figure 4:
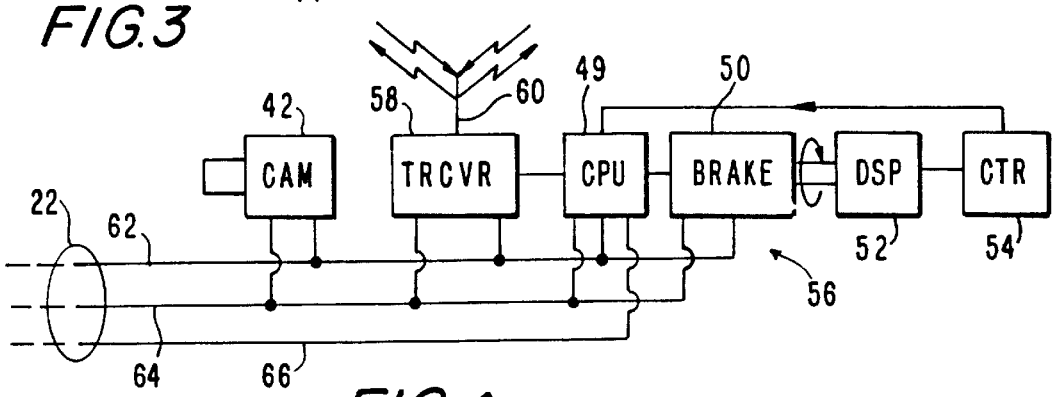
FIG. 4 is a schematic circuit diagram of an alternative embodiment of the electrical system of the invention.

FIGS. 3 and 4 show two different electrical systems for use in the towed vehicle. The electrical system 40 includes the video camera 42, an onboard battery 44 such as a thermally-activated battery, an RF transmitter 46 with an antenna 48 for transmitting the video picture signals, and a microprocessor 49 which can be preprogrammed to provide control signals at appropriate times to actuate an electrical brake 50 which brakes a tether cord dispenser unit 52. A simple counter 54 is provided to count the revolutions of the spool dispensing the tether cord so as to provide this information to the microprocessor 49 for determining when to apply and release the brake 50.

In the embodiment shown in FIG. 3, the tether cord or line carries no electrical conductors or fiber-optic cable because the vehicle 24 has its own internal power supply and supplies its own command signals stored in the microprocessor 49 by the bomb computer 34 before the bomb and towed vehicle separate.

In the embodiment of FIG. 4, the control system 56 differs from that shown in FIG. 3 in that the tether cord 22 contains two conductors 62 and 64, as well as a fiber-optic cable 66. The system 56 has no internal battery. The fiber-optic cable 66 permits the transmission of communications signals between the bomb and the towed vehicle without enemy interference In this embodiment, the application and release of braking forces is controlled by the bomb computer 34, which sends command signals through the fiber-optic cable.

FIG. 4 also shows another alternative embodiment of the invention in which a transceiver 58 is used instead of a transmitter. The transceiver is used both to transmit and receive RF signals by means of an antenna 60. Thus, RF command signals can be received and video signals transmitted, as desired. This embodiment uses RF transmission rather than the fiber-optic cable 66 to send control signals from the bomb or an aircraft to the towed vehicle.

Of course, if the command signals are stored in the microprocessor 49 before deployment of the vehicle 24, neither the cable 66 nor a RF receiving capability are needed.

If the conductors 62 and 64 are used to eliminate the need for a battery in the vehicle 24, then means should be provided for storing electrical charge so as to sustain the electrical power level in the vehicle 24 for a pre-determined time after either the bomb explodes or the vehicle 24 separates from the tether cord. Uninterruptable power supply devices are well known and readily available for the task.

The counter 54 counts the revolutions of the dispensing spool to be discussed below so as to indicate the length of tether cord dispensed, thus making it possible to determine the point at which to stop dispensing the tether cord when a predetermined length of cord has been dispensed, rather than at a predetermined time.

Towed Vehicle Construction

Figure 5:
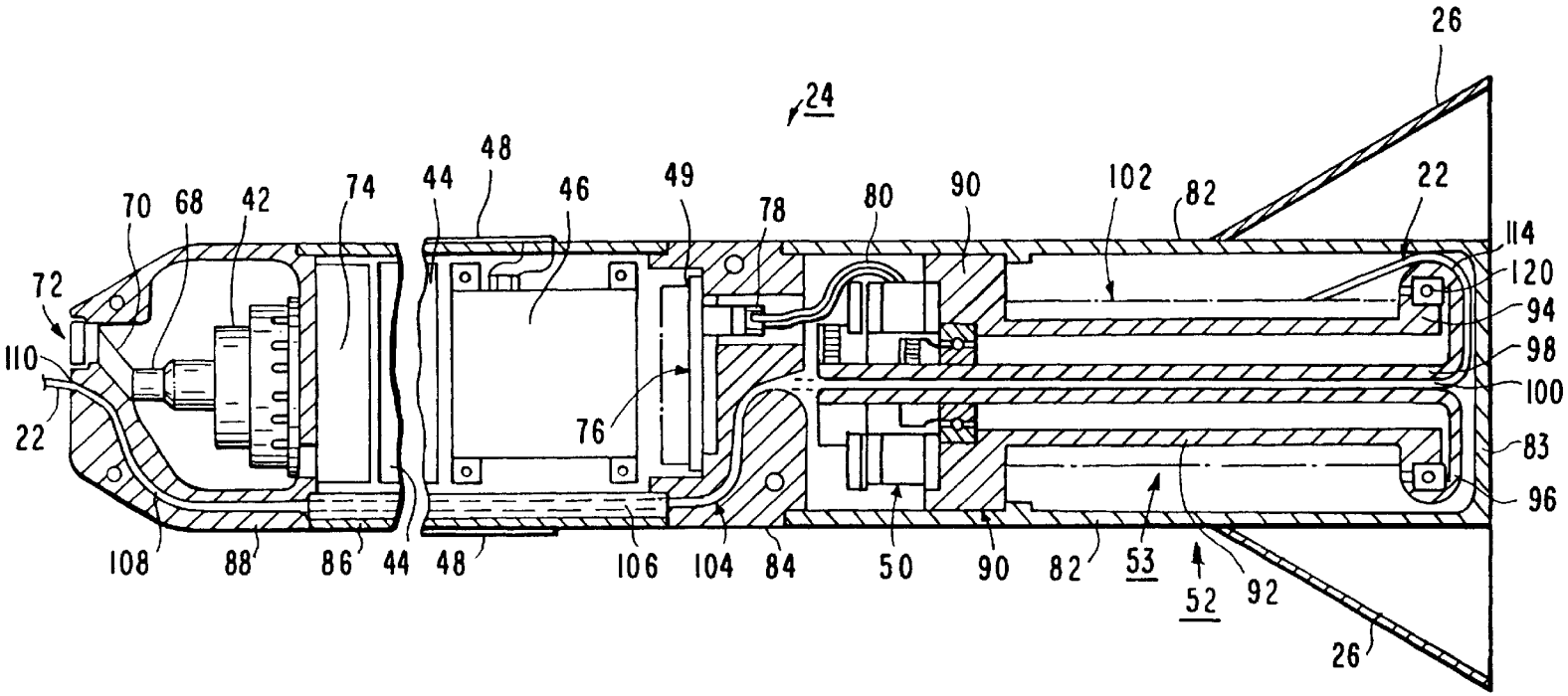
FIG. 5 is a cross-sectional elevation view of a towed vehicle, partially broken away, constructed in accordance with the present invention.

FIG. 5 is a cross-sectional, partially schematic and partially broken-away view of the vehicle 24.

The vehicle 24 has an outer housing formed in part by a cylindrical member 82 with an end wall 83, a central support member 84 to which the cylinder 82 is attached, a second cylindrical housing member 86 secured to the support member 84, and a tapered nose piece 88 at the front end of the vehicle. The cylindrical section 86 has been substantially shortened in the drawings, as indicated by the cut lines in the left hand portion of FIG. 5, for the purpose of facilitating the illustration of the invention.

A frustro-conical shaped tail section 26 is attached to the outside of the housing 82 at the trailing end of the vehicle, that is, at the right-hand end of the vehicle 24 as shown in FIG. 5.

The reference numerals 26 also can be taken to indicate two of four or more fins extending outwardly from the housing. Such fins are an alternative to the conical shape shown in FIG. 5, and preferably are used if the vehicle 24 contains internal guidance means.

As it is well known, the fins can be straight, or they can be bent to impart a twist to the vehicle, or, as noted above, they can be controlled by an internal guidance system if a separate guidance system is needed.

Now referring to the front end of the vehicle 24, that is, the left-hand end, as shown in FIG. 5, a video camera 42 is mounted near a front window 72 in the front end of the vehicle. The video camera includes a lens 68, a prism system 70 to bend the light rays entering the off-axis window 72 and direct them into the lens 68 of the video camera.

The window 72 is off center so that the tether cord 22 can emerge from a centrally-located opening 110 in the vehicle.

The video camera also includes a video processor 74.

To the right of the video processor 74 is a thermally-activated battery 44. Only a portion of the battery is shown, due to space limitations in the drawings.

To the right of the battery 44 is the transmitter 46. The antenna system 48 is located on the outside of the housing folded against the housing surface, as shown in FIG. 5.

To the right of the transmitter is a control circuit card assembly 76, upon which the microprocessor 49 is located. The circuit card 76 and its components communicate with the transmitter, video camera, and the electrical brake to be described below. Electrical communication between the circuit card 76 and the brake 50 is through a cable 80 and connector 78.

A tether cord dispenser 52 is shown in the right-hand portion of FIG. 5. The dispenser includes a spool 53 on which is wound a stack or roll 102 of tether cord. The spool 53 includes a fixed flange member 90 secured to the inside of the cylinder 82, an elongated hollow cylindrical portion 92 upon which the tether cord is wound, and an end flange 94. The cord is wound between the flanges 90 and 94.

Figure 7:
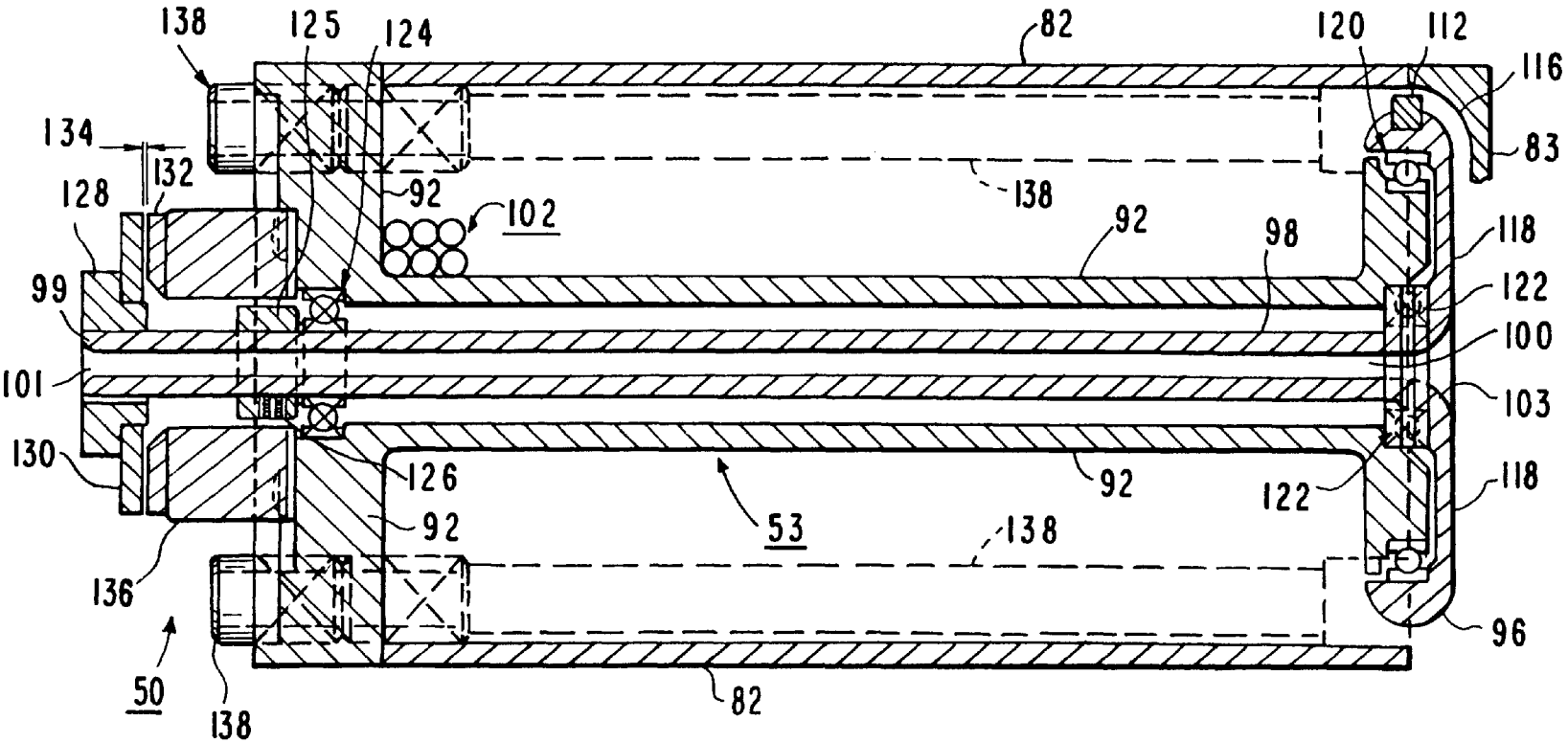
FIG. 7 is an enlarged elevation view of a portion of the device shown in FIG. 5.

Referring now to FIG. 7 as well as to FIG. 5, rotatably mounted on the stationary spool 53 is a relatively light-weight dispensing rotor consisting of a rounded flange portion 96 with an elongated hollow tubular member 98 positioned inside of the hollow interior of the stationary tubular member 92. The rotor is rotatably mounted on the stationary spool structure by means of bearings at 120, 122 and 124. A collar 125 is attached to the tubular member 98 to the left of the bearing 124 by means of a threaded fastener 126.

The tubular member 98 has a central opening 100 which is rounded at its entrance end 103 and at its exit end 99 to provide a smooth guide for a tether cord passing through the inlet 100 and outlet 101.

Figure 6:
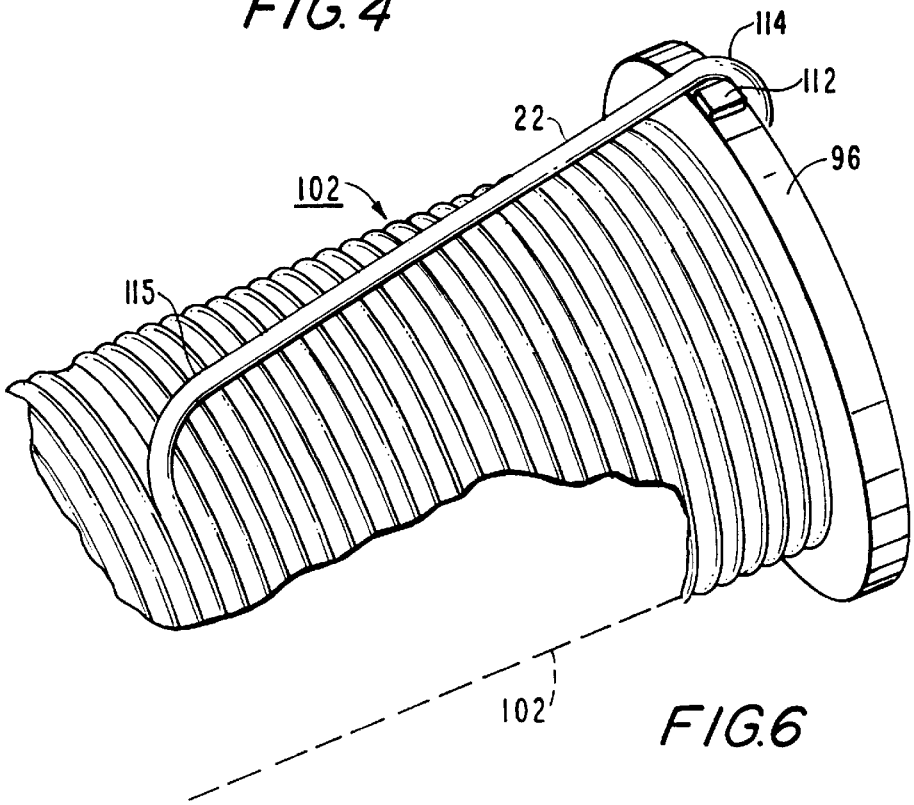
FIG. 6 is a perspective schematic view, partially broken-away, of a portion of the device show in FIG. 5.

As it is shown in FIG. 6, the tether cord 22 wound into the roll 102 is wound in multiple layers, on top of one another. At the location 116 where the cord 22 first leaves the roll 102, adhesive or an easily-tearable fabric fastening means is used to attach the cord to the roll 102 to keep it from unraveling until dispensing is desired.

At the point 114 where the cord 22 bends over the flange 96, it comes in contact with the projection 112 from the surface of the flange 96 and forces the rotor to rotate as the cord is dispensed. Also, the housing 82 is curved at 116, as shown in FIG. 7, to follow the contour of the flange 96 and constrict the outward movement of the cord at that location. The cord 22 passes over the flat end portion 118 of the flange 96 and into the opening 100.

The projection 112 also causes the dispensing to slow down as the brake 50 is applied to slow down or stop the dispensing operation.

Electric Brake

In accordance with another aspect of the present invention, an electrically-operated brake structure 50 is provided at the left end of the tube 98.

As shown in FIG. 7, the electric brake has a stator 136 secured to the flange member 92. A rotor member 128 is secured to the end of the tube 98. Circular discs 130 and 132 are secured, respectively, to the members 128 and 136. This brake is a conventional electromagnetic brake. The parts of the brake are held together with elongated threaded fasteners 138. An example of a suitable brake is one sold by Electroid Company, P/N EC-17B-6-2L.

In operation, the brake discs 130 and 132 normally are mounted so that a small distance 134 is maintained separating them. When electrical energy is applied, the two discs are attracted magnetically towards one another with a force which is a function of the electrical energy supplied to the brake, thus producing a braking force which is variable in accordance with the electrical energy supplied.

Thus, by ramping the electrical energy up gradually, the braking force supplied by the brake can be controlled so as not to put a large shock load on the tether cord when the dispensing of the tether cord is stopped.

Similarly, the brake 50 can be controlled to stop the unwinding of cord at a predetermined time, and then release and allow the cord to unwind completely so as to free the vehicle for continued flight on its own.

Also, the brake 50 can be applied lightly at all times during dispensing of the tether cord so as to prevent the dispensing speed from becoming excessive.

Braking Force Multiplication

In accordance with another aspect of the invention, the braking force provided by the electric brake 50 is multiplied by passing the tether cord 22 through a curved conduit in moving from the outlet opening 101 (FIG. 7) of the tube 98 to the outlet 110 (FIG. 5) at the front end of the vehicle 24.

Referring to FIG. 5, curved passageway consists of a first generally S-shaped section 104, and a second generally S-shaped section 108 which guide the cord 22 through successive reverse bends. These sinuous passageways are interconnected by a straight section 106.

The multiplication of force produced by the sinuous bends in the path of the cord 22 is in accordance with the principle of physics which allows a single seaman to wrap a rope several times about a capstan and hold a large ship close to a dock using a relatively small pulling force on the rope end.

The equation defining the multiplication process is:

$$T_{out}=T_{in}\times e^{bf}$$

Where: $T_{out}$ is the tension in the cord 22 emerging from the front of the vehicle 24; $T_{in}$ is the tension in the line 22 created by the brake 50 and the friction of the cord against the curved surfaces it bears against; b is the total contact angle of the curved surface which is contacted by the cord; and f is the coefficient of friction between the cord and the curved surface, which, in this case, is aluminum.

Thus, the curved path may take several different forms and is not limited to a sinuous conduit. The conduit can be re-entrant in shape, the cord can be wrapped around a capstan anywhere from a fraction of one revolution to several revolutions, as needed, etc.

Thus, when the brake 50 applies force to the line being dispensed through the curved conduit, the force is multiplied and less braking force is required to stop the dispensing of the tether cord. This permits the use of a smaller brake which uses less battery power than if the multiplication system were not used.

Normally, the conduit through which the cord passes is large enough to not overly restrict the passage of the cord through it when the brake 50 is not applied. However, if desired, some braking can be provided by using a somewhat restricted conduit. This might be used to prevent dispensing at excessive speeds, etc.

The benefits of the invention also can be useful in controlling the deployment and operation of vehicles towed by aircraft, as well as by explosive devices.

Towed Vehicle Recovery

Towed vehicles often are relatively expensive. Therefore, in circumstances in which they are not destroyed during the mission, it is desirable to be able to recover the vehicles undamaged for re-use.

An example is in the testing of bomb damage assessment vehicles. Such testing often is done by deploying them from aircraft which dive to simulated a falling bomb, and pull out of the dive when near the ground.

In deploying decoys, test vehicles or target vehicles, the towed vehicles often are cut loose and lost in order to avoid interfering with the flight and landing of the aircraft after deployment ceases to be needed.

In accordance with another aspect of the invention, towed vehicles can be re-positioned or recovered by the use of a winch in the mother craft to wind in the line to recover the vehicle after a mission, with the brake mechanism being used to control deployment. The winch can be used to move the position of the towed vehicle closer to the mother craft, or to pull the towed vehicle all the way back to its home housing.

Figure 8:
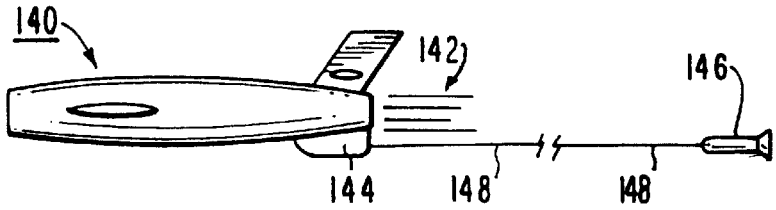
FIG. 8 is a schematic view showing the use of the invention in a jet or rocket-propelled missile.

FIG. 8 of the drawings schematically shows a cruise missile 140 utilizing such a recovery mechanism.

The missile has a hot jet stream 142 issuing from its aft end, and a towed vehicle compartment 144 secured to its undersurface. A tether cord 148 is anchored in the compartment and a towed vehicle 146 such as a traveling explosive device damage detector trails the missile 140 at a substantial distance after using a mechanism such as that shown in FIGS. 5–7 to control the deployment of the vehicle.

Figure 10:
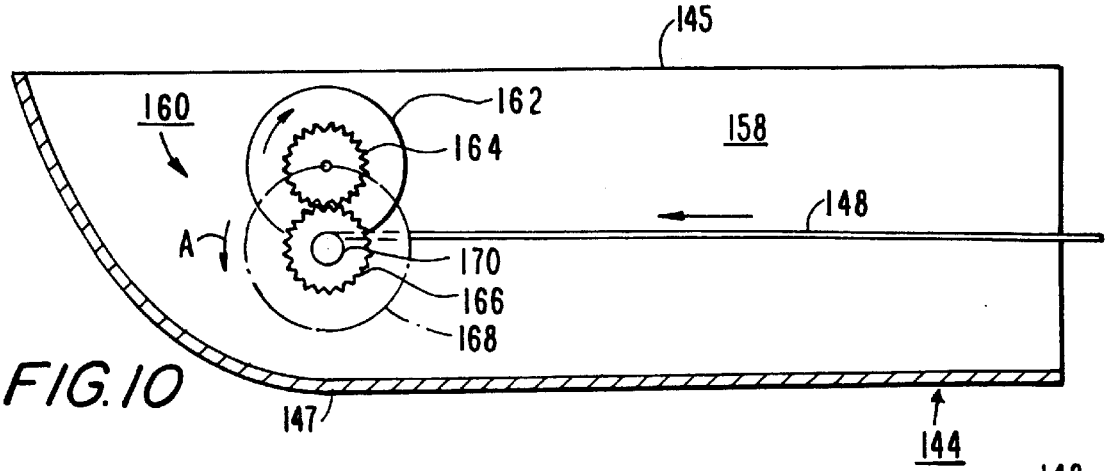
FIG. 10 is a cross-sectional view of a portion of the device shown in FIG. 8.

FIG. 10 is a cross-sectional view of the compartment 144 attached to the underside 145 of the missile 140.

The compartment 144 has an outer wall 147 which is streamlined to reduce drag.

A winch 160 is positioned in the compartment 144 at the forward end, and there is a storage space 158 and mounting structure (not shown) for storing and holding the vehicle 146 before deployment and after retrieval.

The tether cord 148 is tied at its end to the spindle 170 of the winch 160. This anchors the tether during deployment.

The winch includes an electric motor 162 driving a spur gear 164 which is meshed with and rotates a spur gear 166 in the direction of arrow A when the motor 162 is energized. This winds the tether cord 148 on the spindle 170 and pulls the vehicle 146 back into the compartment 144.

The winch 160 preferably is provided with a level-winding mechanism (not shown) and a feeler switch (not shown) which stops the motor when the vehicle 146 contacts it upon its reentry into the compartment 144.

Figure 9:
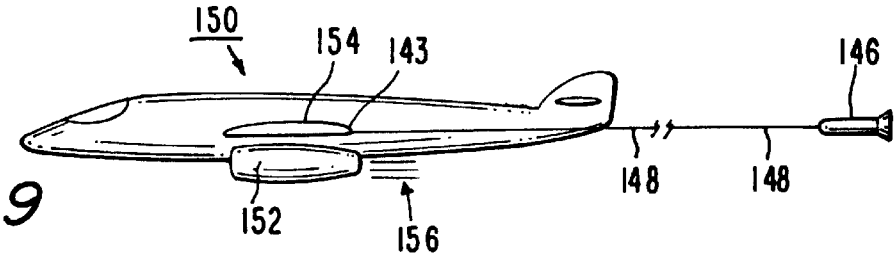
FIG. 9 is a schematic view showing the use of the invention with an airplane.

FIG. 9 shows a multi-engine jet aircraft 150 towing the vehicle 146. The aircraft 150 has multiple wing-mounted jet engines 152 issuing hot exhaust streams 156. A compartment 143 in the trailing edge of one wing 154 of the aircraft houses the vehicle 146 and a winch such as the winch 160 to perform the same functions as those described above for the FIG. 10 structure.

The compartment is built into the wing 154 so as not to disturb the streamlines of the wing.

In general, it is preferred to store the vehicle 146 in a streamlined compartment, if possible.

Tether Protection

Another problem with towed airborne vehicles is that the tether cord 148 can be damaged or destroyed by the hot gases in the jet exhaust streams 142 and 156. This restricts the ability of the mother craft to maneuver because to do so might cause the loss of the towed vehicle.

Figure 11:
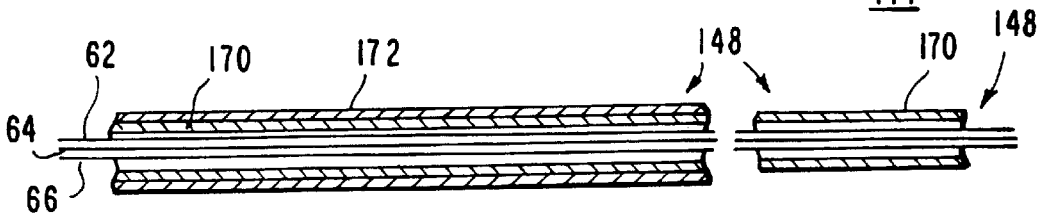
FIG. 11 is a schematic cross-sectional view of a tether cord used in the embodiments of FIGS. 8 and 9.

In accordance with a further aspect of the invention, this problem is solved by using a fire-resistant sheath 172 (FIG. 11) to cover a portion of the tether cord 148. The cord 148 shown in FIG. 11 has conductors 62 and 64 and fiber-optic cable 66 inside of a sheath 170 made of Kevlar or other strong plastic material as described above. The outer sheath 172 can be made of asbestos or other highly fire-resistant material.

It is desired to restrict the sheath 172 only to the relatively short section of the tether which is close to the jet exhausts.

In accordance with this invention, this can be accomplished by using the on-board storage and dispensing of the tether. By so doing, the anchor point of the tether remains fixed relative to the jet exhaust zones, and the fire-resistant cover 172 can be made to cover only the first 50 to 75 feet or so of tether, without restricting the variation of the distance to which the vehicle 146 is deployed.

By use of the towed vehicle recovery device and method described above, vehicles can be recovered and reused without impairing the flight of an aircraft, and without the tether burning through.

When one of the units 24 shown in FIGS. 5–7 is recovered, it can be removed from the mother craft and replaced with a unit in which the cord has been wound on the spool 53. Then, the unit removed can be rewound and used on a later mission.

Materials

Advantageously, the components of the vehicle body can be made of aluminum. This includes the housings 82 and 86, the nose piece 88, the body 84, and the members 90, 94, 96, 98, etc., as well as the cone or fins 26.

The tether cord 22 preferably is made of very strong, lightweight plastic materials such as liquid crystal polymers sold under the trademarks 'Vectran' and "Kevlar". If wires and fiber-optic cable are to be integrated with the tether line, a knitted sleeve of that material can be advantageous. The wires and cable can be inserted into the sleeve to form a power and signal carrying tether.

The above description of the invention is intended to be illustrative and not limiting. Various changes or modifications in the embodiments described may occur to those skilled in the art. These can be made without departing from the spirit or scope of the invention.

What is claimed is:

1. A traveling explosive device damage detector, said detector comprising:

(a) a traveling explosive device;

(b) a support structure;

(c) a camera and a transmitter mounted on said support structure for transmitting signals representing pictures taken by said camera when said camera is pointed at a location at which said traveling explosive device is exploded;

(d) a tether cord for connection between said traveling explosive device and said damage detector;

(e) a spool mounted in one of said traveling explosive device and said damage detector for storing and dispensing said cord;

(f) an electric brake mounted adjacent said spool for slowing the dispensing of said cord from said spool in response to a control signal; and (g) a programmed computer for developing and sending said control signal to said electric brake.

2. A traveling explosive device damage detector as claimed in claim 1 including a curved conduit for guiding said cord from said spool through at least one bend to multiply the braking force provided by said brake.

3. A traveling explosive device damage detector as in claim 2 in which said cord includes at least one generally S-shaped conduit section.

4. A traveling explosive device damage detector as in claim 2 in which said support structure includes a housing having forward and aft sections, said camera being located in said forward section and said spool and said brake in said aft section, there being an outlet opening in said forward section of said housing for dispensing said tether cord, said conduit guiding said cord from said reel through said forward section, around said camera, and out through said outlet opening.

5. A traveling explosive device damage detector as claimed in claim 1 in which said spool is elongated and has a central core with a dispensing end flange, said cord being wound on said core, and including a guide structure for guiding said cord in a generally longitudinal direction over said end flange when being dispensed.

6. A traveling explosive device damage detector as claimed in claim 1 including a power supply device selected from the group consisting of: a battery; and at least one electrical conductor in said cord.

7. A traveling explosive device damage detector as in claim 1 in which said programmed computer is programmed to cause said damage detector to be released from said traveling explosive device prior to said traveling explosive device reaching said location at which it is exploded.

8. A traveling explosive device damage detector as in claim 7 including guidance means for keeping said cameras aimed at said traveling explosive device after the release of said damage detector.

9. A traveling explosive device damage detector as in claim 1 in which said spool has a longitudinal axis, with said cord being wound in a direction around said longitudinal axis, said spool being positioned on said support structure to be stationary with respect to said support structure and with said longitudinal axis pointed in the direction of travel of said damage detector, with said cord being dispensed from said spool in the direction of said longitudinal axis.

10. A traveling explosive device damage detector as in claim 9 in which said spool has a hollow cord and at least one end flange, said cord moves off of said spool, over said flange, and through said hollow core, said flange being rotatable with respect to said spool and having an engagement structure for engaging said cord with said flange to drive said flange at a speed determined by the rate of dispensing said cord.

11. A traveling explosive device damage detector as in claim 10 including a measuring device for counting the revolutions of said flange to give a measurement of the length of cord dispensed from said reel.

12. A traveling explosive device damage detector, said detector comprising:

(a) a support structure;

(b) a camera and a transmitter mounted on said support structure for transmitting signals representing pictures taken by said camera when said camera is pointed at a location at which a traveling explosive device is exploded;

(c) a tether cord for connection between a traveling explosive device and said damage detector;

(d) a spool mounted in one of a traveling explosive device and said damage detector for storing and dispensing said cord;

(e) an electric brake mounted adjacent said spool for slowing the dispensing of said cord from said spool in response to a control signal;

(f) a programmed computer for developing and sending said control signal to said electric brake, (g) in which said spool is elongated and has a central core with a dispensing end flange, said cord being wound on said core, and including a guide structure for guiding said cord in a generally longitudinal direction over said end flange when being dispensed, and (h) in which said end flange is rotatably mounted with respect to said spool, and said end flange has a catch device to engage said cord so as to cause said end flange to rotate as said cord is pulled off of said spool, said electrical brake being adapted to slow and stop the rotation of said end flange.

13. A traveling explosive device damage detector, said detector comprising:

(a) a support structure;

(b) a camera and a transmitter mounted on said support structure for transmitting signals representing pictures taken by said camera when said camera is pointed at a location at which a traveling explosive device is exploded;

(c) a tether cord for connection between said traveling explosive device and said damage detector;

(d) a spool mounted in one of a traveling explosive device and said damage detector for storing and dispensing said cord;

(e) an electric brake mounted adjacent said spool for slowing the dispensing of said cord from said spool in response to a control signal;

(f) a programmed computer for developing and sending said control signal to said electric brake, (g) in which said spool is elongated and has a central core with a dispensing end flange, said cord being wound on said core, and including a guide structure for guiding said cord in a generally longitudinal direction over said end flange when being dispensed, and (h) in which said core is hollow and said cord passes through said hollow core while being dispensed.

* * * * *